US009132676B2

(12) United States Patent
Bigford et al.

(10) Patent No.: US 9,132,676 B2
(45) Date of Patent: Sep. 15, 2015

(54) PRINTHEAD ASSEMBLY DATUM

(75) Inventors: Rosanna L. Bigford, Albany, OR (US); Kelly B. Smith, Corvallis, OR (US); Daniel D. Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/374,634

(22) PCT Filed: Jan. 27, 2012

(86) PCT No.: PCT/US2012/022818

§ 371 (c)(1), (2), (4) Date: Jul. 25, 2014

(87) PCT Pub. No.: WO2013/112168

PCT Pub. Date: Aug. 1, 2013

(65) Prior Publication Data

US 2015/0202905 A1 Jul. 23, 2015

(51) Int. Cl.
*B41J 2/175* (2006.01)
*B41J 25/34* (2006.01)

(52) U.S. Cl.
CPC ..... *B41J 25/34* (2013.01); *B41J 2/1752* (2013.01)

(58) Field of Classification Search
USPC ..... 347/85, 86, 87
See application file for complete search history.

(56) References Cited

U.S. PATENT DOCUMENTS

| | | | | |
|---|---|---|---|---|
| 6,050,664 | A | 4/2000 | Wilson, II | |
| 6,298,783 | B1 | 10/2001 | O'Mera et al. | |
| 6,618,563 | B2 | 9/2003 | Oakeson et al. | |
| 7,413,284 | B2 | 8/2008 | Higginson et al. | |
| 7,665,815 | B2 | 2/2010 | Swett et al. | |
| 7,794,079 | B2 | 9/2010 | Von Essen et al. | |
| 2005/0243127 | A1 | 11/2005 | Higginson et al. | |
| 2011/0025776 | A1* | 2/2011 | Rosati et al. | 347/34 |
| 2011/0149000 | A1 | 6/2011 | Albertalli et al. | |
| 2011/0273502 | A1 | 11/2011 | Eun et al. | |
| 2012/0019593 | A1 | 1/2012 | Scheffelin et al. | |

OTHER PUBLICATIONS

International Search Report, dated Oct. 31, 2012, for PCT/US2012/022818, filed Jan. 27, 2012.

* cited by examiner

*Primary Examiner* — Huan Tran
(74) *Attorney, Agent, or Firm* — Hewlett-Packard Patent Department

(57) ABSTRACT

In one example, a printhead assembly datum includes stationary first and second points and a movable third point that define a datum plane for the printhead assembly. The stationary first and second points define a line in the datum plane and the third point is movable so that the datum plane pivots on the line in response to movement of the third point. In another example, a printhead assembly includes a body, a printhead attached to the body, and a datum for adjusting a position of the printhead relative to a component external to the printhead assembly. The datum is formed by first, second, and third datum points on the body that define a triangle representing a datum plane that is tiltable on the base of the triangle by moving the vertex opposite the base.

15 Claims, 11 Drawing Sheets

PRINTHEAD ASSEMBLY DATUM

CROSS-REFERENCE TO RELATED APPLICATION

Pursuant to 35 U.S.C. §371, this application is a United States National Stage Application of International Patent Application No. PCT/US2012/022818, filed on Jan. 27, 2012, the contents of which are incorporated by reference as if set forth in their entirety herein.

BACKGROUND

In some inkjet printers, a substrate wide stationary printhead or group of printheads commonly referred to as a print bar is used to print on paper or other print substrates moving past the print bar. Substrate wide print bars include a structural interface that allows each print bar to be accurately mounted in the printer.

DRAWINGS

The same part numbers are used to designate the same or similar parts throughout the figures.

DESCRIPTION

Figure 1:
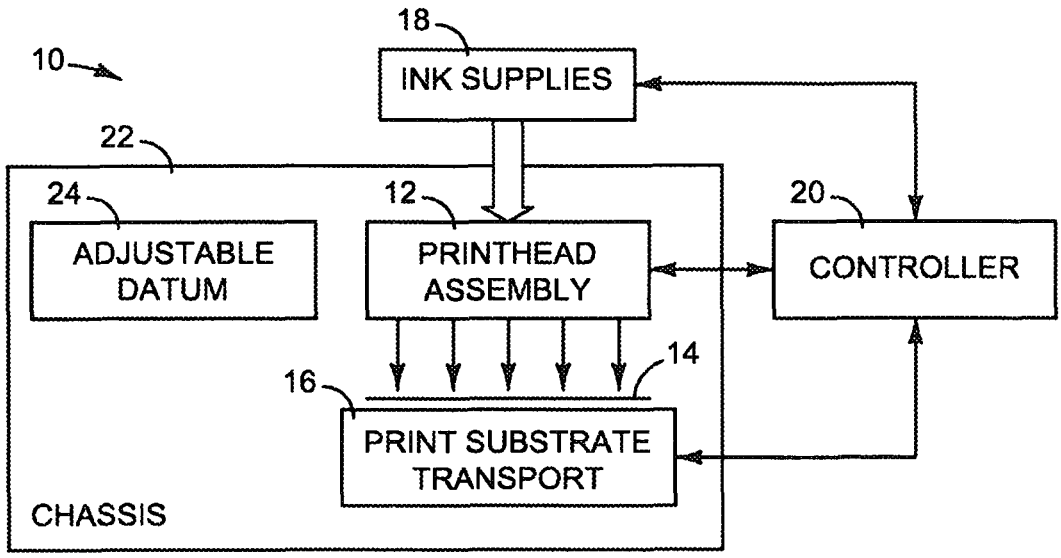
FIG. 1 is a block diagram illustrating one embodiment of an inkjet printer in which examples of a new printhead assembly and adjustable printhead assembly datum may be implemented.

Examples of a new printhead assembly and adjustable printhead assembly datum were developed in an effort to provide a structural interface between a modular, substrate wide print bar and a printer chassis that allows the print bar modules to be accurately mounted in the printer in a repeatable way that supports cost effective mass production of the print bar modules. Thus, the new printhead assembly may be implemented, for example, as a module grouped together with other modules in a substrate wide print bar. The new printhead assembly might also be implemented as a single substrate wide assembly that itself spans the full width of the print substrate, or as a carriage mounted ink pen that is scanned back and forth across the print substrate. In one example of the new adjustable datum, stationary first and second points and a movable third point define a datum plane for the printhead assembly. The third datum point is movable so that the datum plane pivots on a line between the first and second datum points in response to movement of the third datum point. The adjustable datum helps enable a precisely controlled structural interface on the printhead assembly (to the printer chassis) that can be completed late in the printhead assembly manufacturing process largely unaffected by lower cost parts and manufacturing processes.

The examples shown in the figures and described herein are non-limiting examples. Other examples are possible and nothing in this Description should be construed to limit the scope of the invention, which is defined in the Claims that follow the Description.

As used in this document, a "datum" means something used as a basis for positioning, measuring or calculating; a "liquid" means a fluid not composed primarily of a gas or gases; and a "printhead" means that part of an inkjet printer or other inkjet type dispenser that expels liquid from one or more openings, and includes but is not limited to what is commonly referred to as a printhead die, a printhead die assembly, and/or a printhead die carrier assembly. A "printhead" is not limited to printing with ink but also includes inkjet type dispensing of other liquids and/or for uses other than printing.

The translational and rotational degrees of freedom for one example of the new printhead assembly are described with reference to X, Y and Z axes in a three dimensional Cartesian coordinate system, where the X axis extends in a direction along the length of the printhead assembly (which is laterally across a print zone perpendicular to the direction the print substrate moves through the print zone when the printhead assembly is installed in a printer), the Y axis extends in a direction across the width of the printhead assembly (which is the same direction the print substrate moves through the print zone when the printhead assembly is installed in the printer), and the Z axis is perpendicular to the X and Y axes. In the examples shown, the X and Y axes extend horizontally and the Z axis extends vertically. This is just one example orientation for the X, Y, and Z axes. While this orientation for the X, Y, and Z axes may be common for many inkjet printing applications, other orientations for the X, Y, and Z axes are possible.

FIG. 1 is a block diagram illustrating one embodiment of an inkjet printer in which examples of a new printhead assembly and adjustable printhead assembly datum may be implemented. Referring to FIG. 1, printer 10 includes a printhead assembly 12 spanning the width of a print substrate 14. Printhead assembly 12 includes an arrangement of one or more printheads for dispensing ink on to a sheet or continuous web of paper or other print substrate 14. Printer 10 also includes a print substrate transport mechanism 16 for moving substrate 14, ink supplies 18 for supplying ink to printhead assembly 12, and an electronic printer controller 20. Controller 20 represents generally the programming, processor(s) and associated memories, and the electronic circuitry and components needed to control the operative elements of printer 10. A printer chassis 22 supports printhead assembly 12 and other elements of printer 10. As described in detail below, printhead assembly 12 is positioned in printer chassis 22 using an adjustable datum 24.

Figure 2:
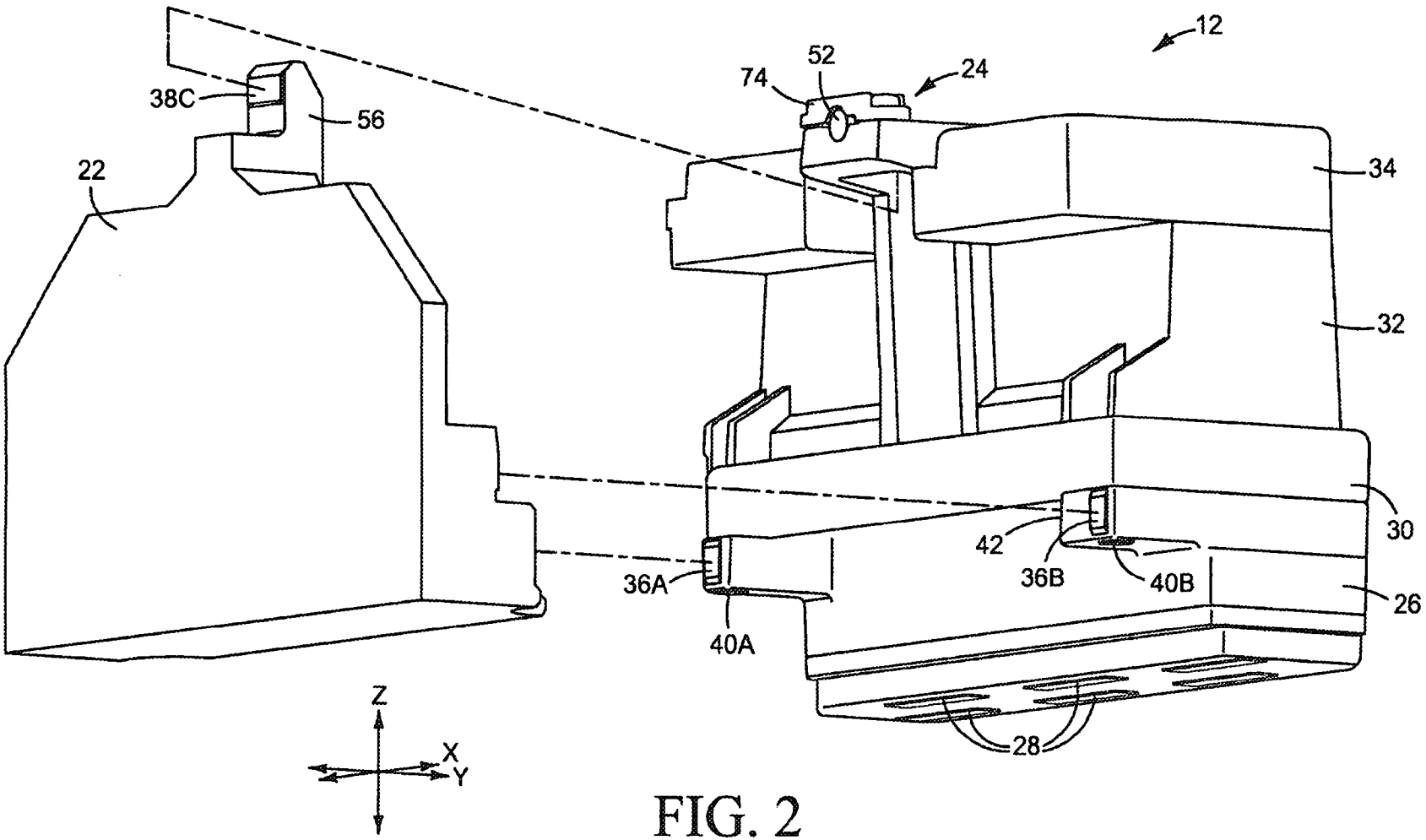
FIGS. 2 and 3 are exploded perspective rear views illustrating a printhead assembly implementing one example of a new, adjustable printhead assembly datum. The printhead assembly cover is omitted in FIG. 3 to better illustrate some of the features in this example of the new printhead assembly.
Figure 3:
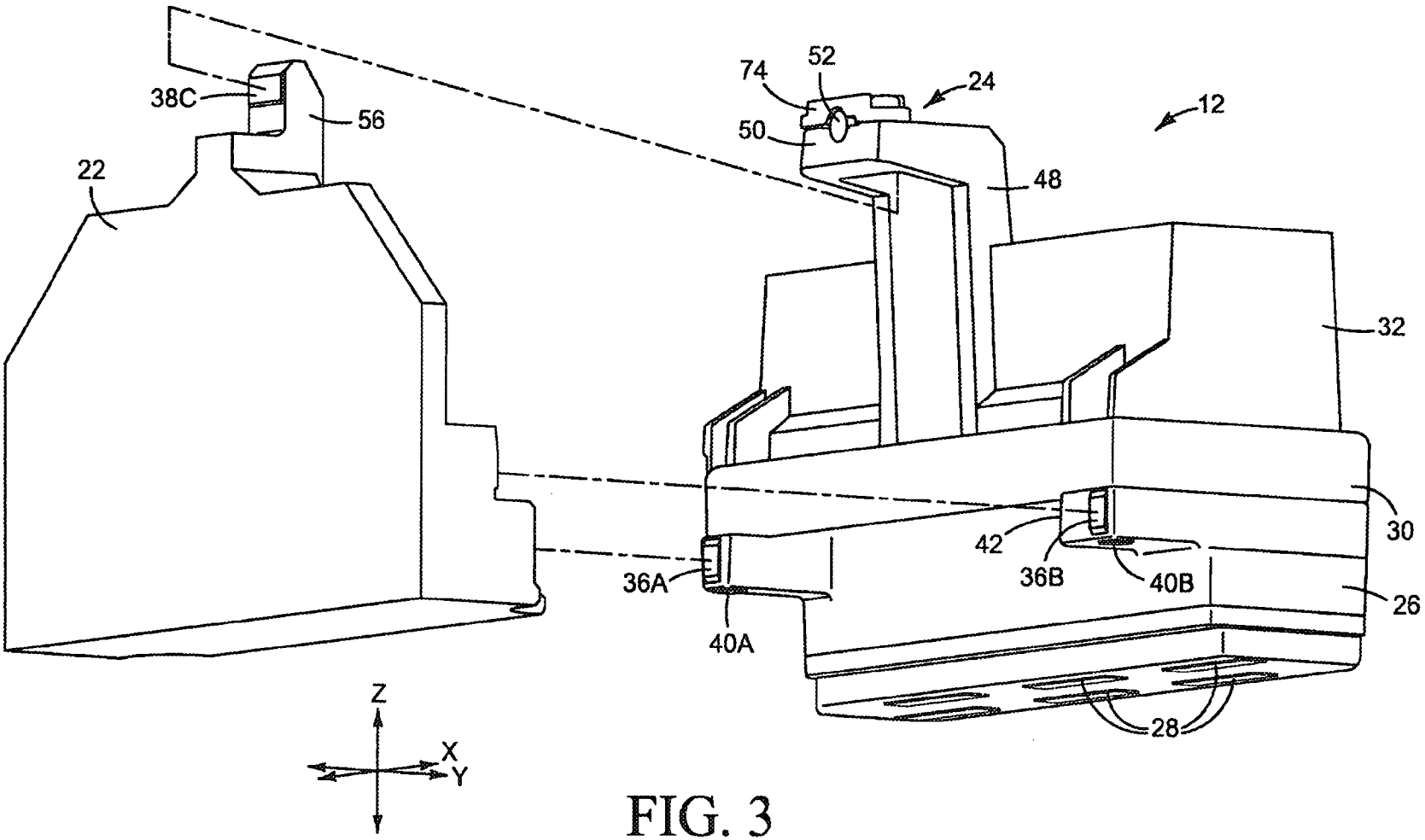
Figure 4:
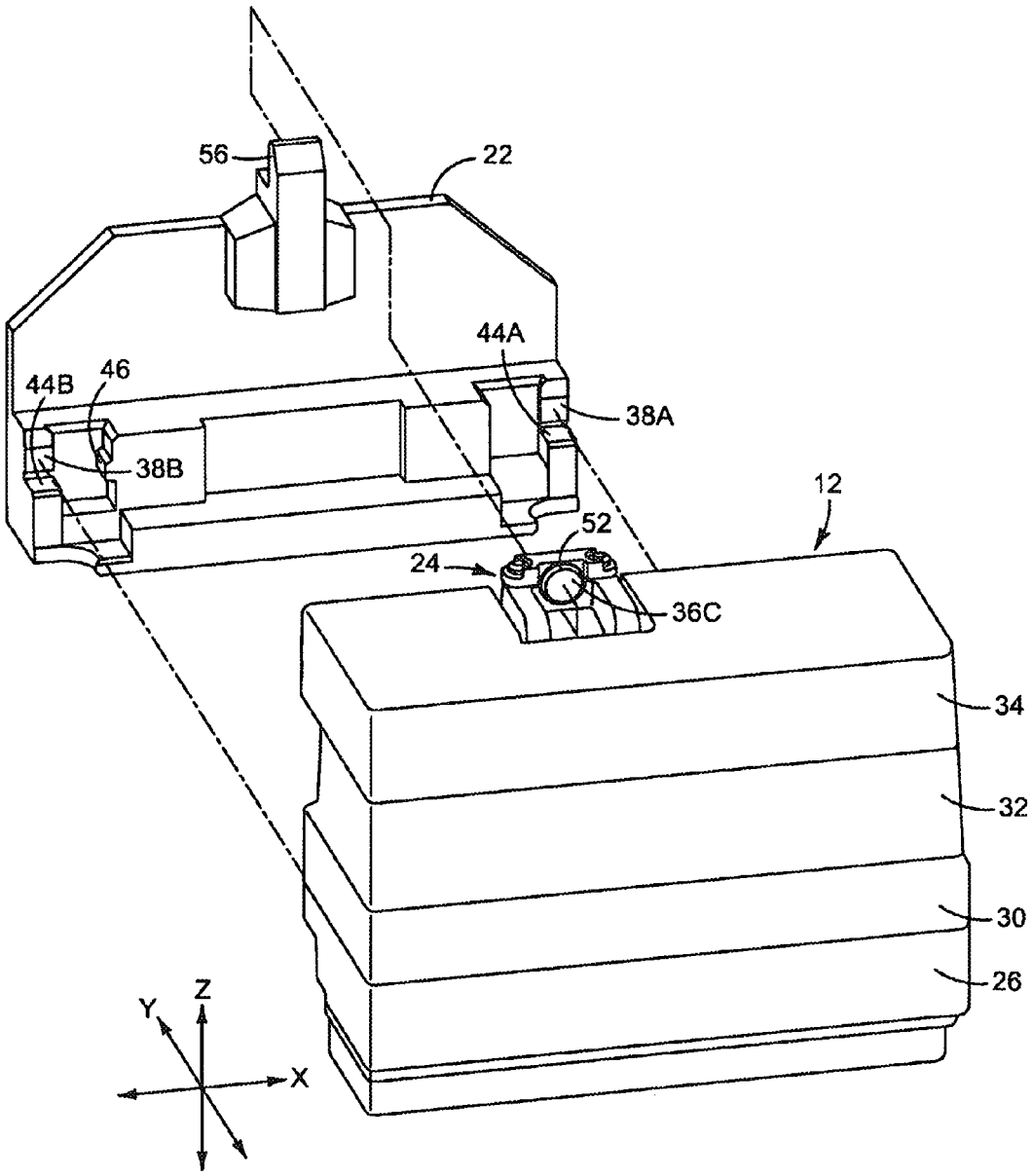
FIG. 4 is an exploded perspective front view illustrating the printhead assembly and printhead assembly datum shown in FIGS. 2 and 3.

FIGS. 2-4 are exploded perspective views illustrating one example of a printhead assembly 12 implementing an adjustable datum 24 that helps correctly position printhead assembly 12 in a printer chassis or manufacturing fixture 22. The printhead assembly cover is omitted in FIG. 3 to better illustrate some of the features of printhead assembly 12 and datum 24. A printhead assembly 12 such as that shown in FIGS. 2-4 may be a substrate wide part that spans substantially the full width of a print substrate 14 (FIG. 1) or printhead assembly 12 may itself be one of a group of printhead assembly modules that together span a print substrate 14 (FIG. 1). In the example shown in FIGS. 2-4, printhead assembly 12 includes four sub-assemblies: a lower body 26 that houses multiple printheads 28; an ink distribution manifold 30; an upper body 32; and a cover 34. The configuration of printhead assembly 12 shown in FIGS. 2-4 is just one example. Other suitable configurations are possible. For example, fewer or more parts may be used and the size, shape and function of each part may be different from those shown. However, presently, it is difficult to cost effectively fabricate the complex ink flow paths and containment and support structures in a single part for a printhead assembly 12 wider than about 10 cm. Thus, these elements are formed in multiple parts glued, welded, screwed or otherwise fastened to one another, for example as shown in FIGS. 2-4. Also, an assembly of multiple parts facilitates the selective use of higher cost materials such as cast metal in combination with lower cost materials such as molded plastic in the fabrication of a printhead assembly 12.

Dispensing ink accurately onto the print substrate 14 depends on correctly positioning the printheads in the printer. Printheads 28 are correctly positioned by precisely controlling the placement of printhead assembly 12 in printer chassis 22. The placement of printhead assembly 12 in printer chassis 22 is controlled through a set of datum points. It is usually desirable to maximize the distance between datum points to improve the precision with which a printhead assembly 12 can be placed in a printer chassis 22. Maximizing the distance between datum points in a multiple part printhead assembly 12 may require locating the datum points on different parts of the printhead assembly, thus introducing assembly tolerances that can make consistent, precise placement more difficult. A new printhead assembly datum 24 has been developed to help resolve this problem. As described below, stationary first and second points and a movable third point represent a datum plane for the printhead assembly. The stationary first and second points define a line that lies in the datum plane and the third point is movable so that the datum plane pivots on the line in response to movement of the third point. Examples of the new datum 24 enable a structural interface to the printer chassis that can be completed late in the printhead assembly manufacturing process largely unaffected by the larger tolerances that are usually required when using lower cost parts and the dimensional shifts that manufacturing processes create when fastening sub-assemblies together.

Referring to FIGS. 2-4, datum 24 includes three datum points physically embodied in reference surfaces 36A, 36B, and 36C on printhead assembly 12. Reference surfaces 36A and 36B are visible in FIGS. 2 and 3. Reference surface 36C is visible in FIG. 4. The same part numbers (36A, 36B, and 36C) are used to designate both datum points and the reference surfaces that embody those datum points. First and second datum points 36A and 36B on printhead assembly 12 are stationary. "Stationary" in this context means the position of each point 36A and 36B on printhead assembly 12 is fixed. Third reference surface 36C on printhead assembly 12 is movable in the Y direction, and thus the position of third datum point 36C is adjustable in the Y direction.

Six datum points may be used to correctly position and constrain printhead assembly 12 in all six degrees of freedom of motion. In the example shown in FIGS. 2-4, three datum points 36A, 36B, and 36C form a primary datum 24, two datum points 40A and 40B form a secondary datum, and one datum point 42 forms a tertiary datum. The three primary datum reference surfaces 36A, 36B, and 36C abut mating surfaces 38A, 38B, and 38C on fixture 22 to establish the correct translational position of printhead assembly 12 in the Y direction and the correct rotational position of printhead assembly 12 about the X and Z axes. The datum that constrains translation in the Y direction is commonly referred to as the Y datum. The two secondary datum reference surfaces 40A and 40B abut mating surfaces 44A and 44B on fixture 22 to establish the correct translational position of printhead assembly 12 in the Z direction and the correct rotational position of printhead assembly 12 about the Y axis. The datum that constrains translation in the Z direction is commonly referred to as the Z datum. The single tertiary datum reference surface 42 abuts a mating surface 46 on fixture 22 to establish the correct translational position of printhead assembly 12 in the X direction. The datum that constrains translation in the X direction is commonly referred to as the X datum.

Figure 5:
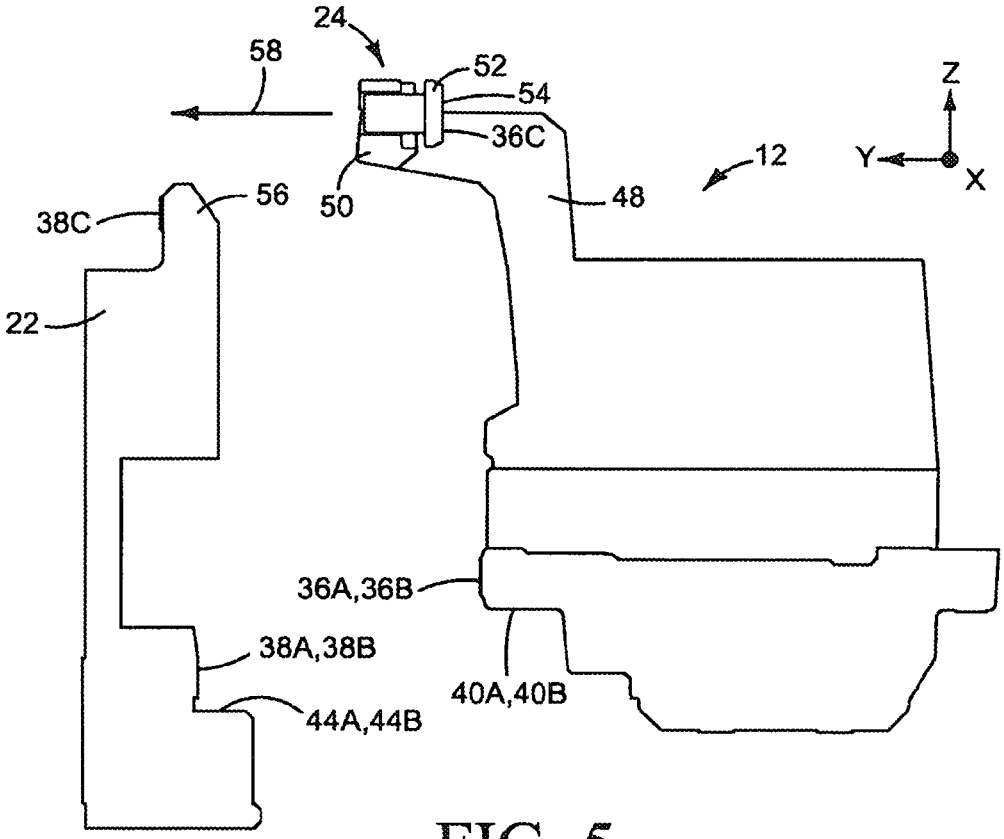
FIGS. 5-7 show a sequence of side views that illustrate mounting the printhead assembly of FIGS. 2-4 into a printer chassis or manufacturing fixture.
Figure 6:
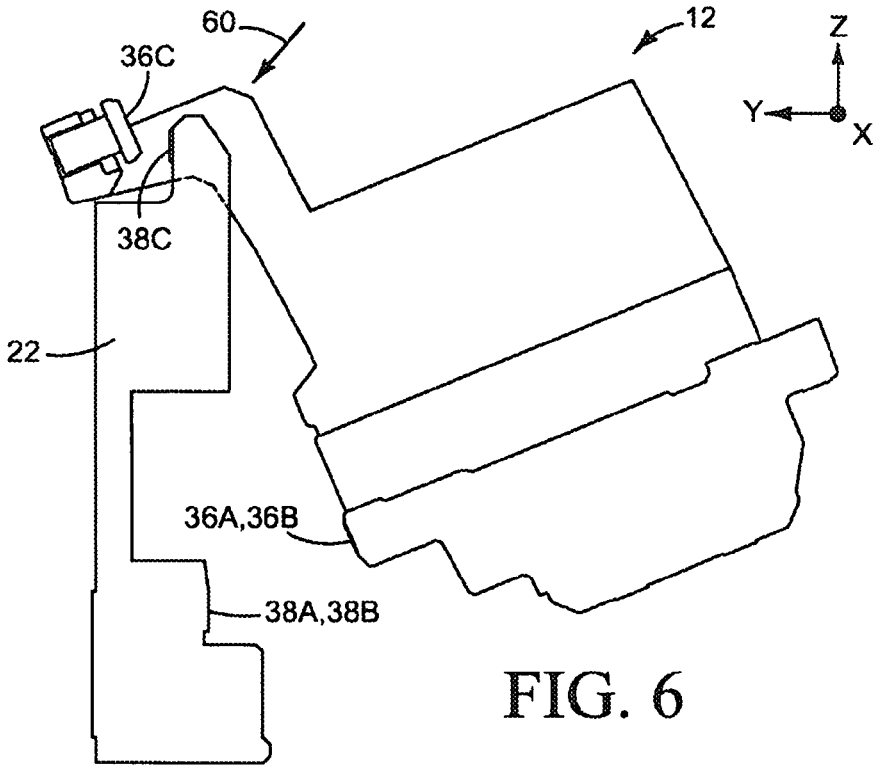
Figure 7:
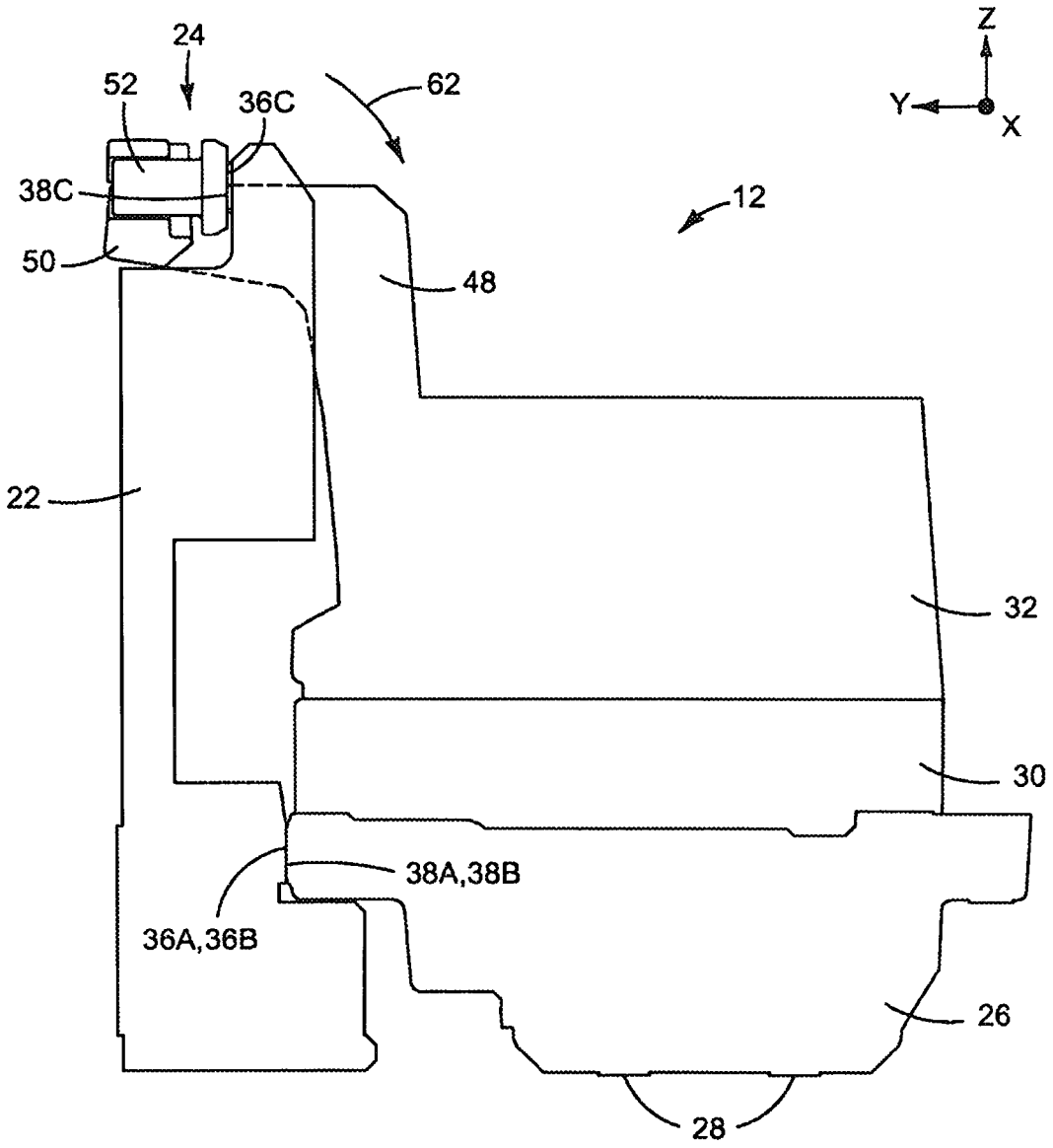

FIGS. 5-7 show a sequence of side views that illustrate mounting printhead assembly 12 into a printer chassis or manufacturing fixture 22. Printhead assembly cover 34 is omitted from FIGS. 5-7 to better illustrate mounting printhead assembly 12 into fixture 22. While the alignment of printhead assembly 12 may be adjusted at the time printhead assembly 12 is installed into a printer chassis, it is expected that the alignment of printhead assembly 12 will usually be made during the manufacturing process using a fixture that mimics the printer chassis. Hence, part number 22 is used in FIGS. 2-7 to designate a printer chassis or a manufacturing fixture.

Referring to FIGS. 2-7, upper body 32 includes an L shaped neck 48 that ends in a hook 50. A pin 52 is clamped to hook 50. Third reference surface 36C is formed on the face 54 of pin 52, facing away from first and second reference surfaces 36A and 36B. Fixture third reference surface 38C is formed on the backside of a post 56 on fixture 22 facing away from fixture first and second reference surfaces 38A and 38B. To mount printhead assembly 12 into fixture 22, neck 48 is hooked over fixture post 56 as shown in FIG. 6, and the lower body of printhead assembly 12 lowered and rotated into contact with fixture 22 as shown in FIG. 7. Direction arrows 58, 60, and 62 in FIGS. 5, 6, and 7, respectively, indicate the motion for mounting printhead assembly 12 in fixture 22. The hooked configuration for mounting printhead assembly 12 shown in FIGS. 2-7 utilizes the torque generated by the weight of printhead assembly 12 hanging from fixture 22 to help urge printhead assembly references surfaces 36A-36C into contact with the corresponding fixture reference surfaces 38A-38C.

As noted above, it is usually desirable to maximize the distance between datum points to improve the precision with which the printhead assembly can be placed in the printer chassis. Thus, reference surfaces 36A and 36B are located at each end of printhead assembly lower body 26 and reference surface 36C is located at the top of the neck 48 of upper body 32. Locating the reference surfaces near the extremes of printhead assembly 12 increases the length of the rotational lever arm between datum points and, accordingly, decreases the size of the change in position of the printhead assembly caused by misalignment or movement of a datum point. Because printhead assembly 12 is sufficiently long (in the X direction), both the first and second reference surfaces 35A and 36B can be located on the same part (lower body 26) and, consequently, the position of these two reference surfaces 36A and 36B need not be adjustable to achieve an acceptable degree of precision placing printhead assembly 12 in the printer chassis. Other suitable configurations for locating reference surfaces 36A, 36B, and 36C may be possible. For example, it may be desirable for some printhead assembly designs to locate adjustable reference surface 36C on cover 34 or on lower body 26 (or on an extension of lower body 26). Also, while it is expected that only one point of printhead assembly datum 24 will be adjustable in most implementations for a printhead assembly 12, it may nevertheless be desirable in some implementations to utilize two or even three adjustable datum points.

Figure 9:
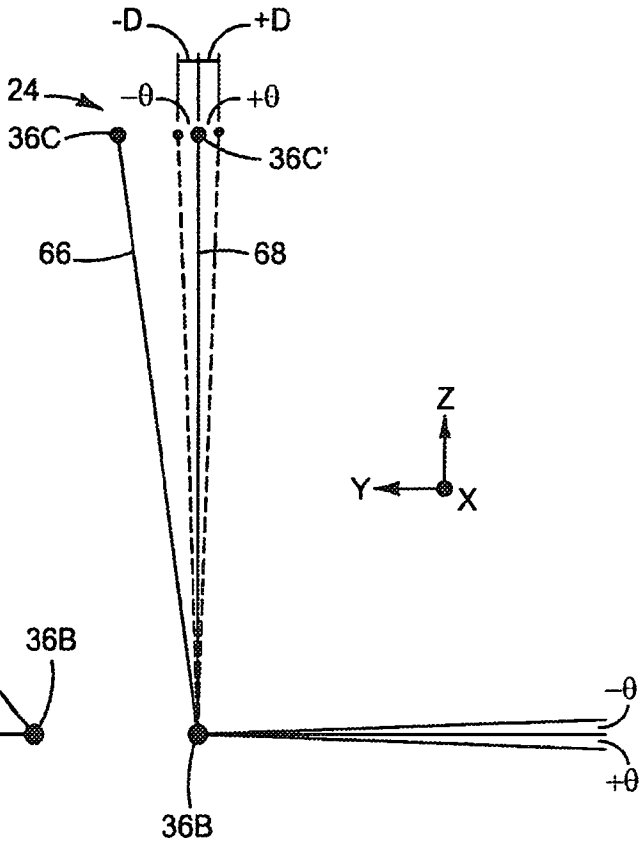
FIGS. 8 and 9 are rear and side view diagrams, respectively, illustrating the adjustable datum in the printhead assembly of FIGS. 2-4.
Figure 8:
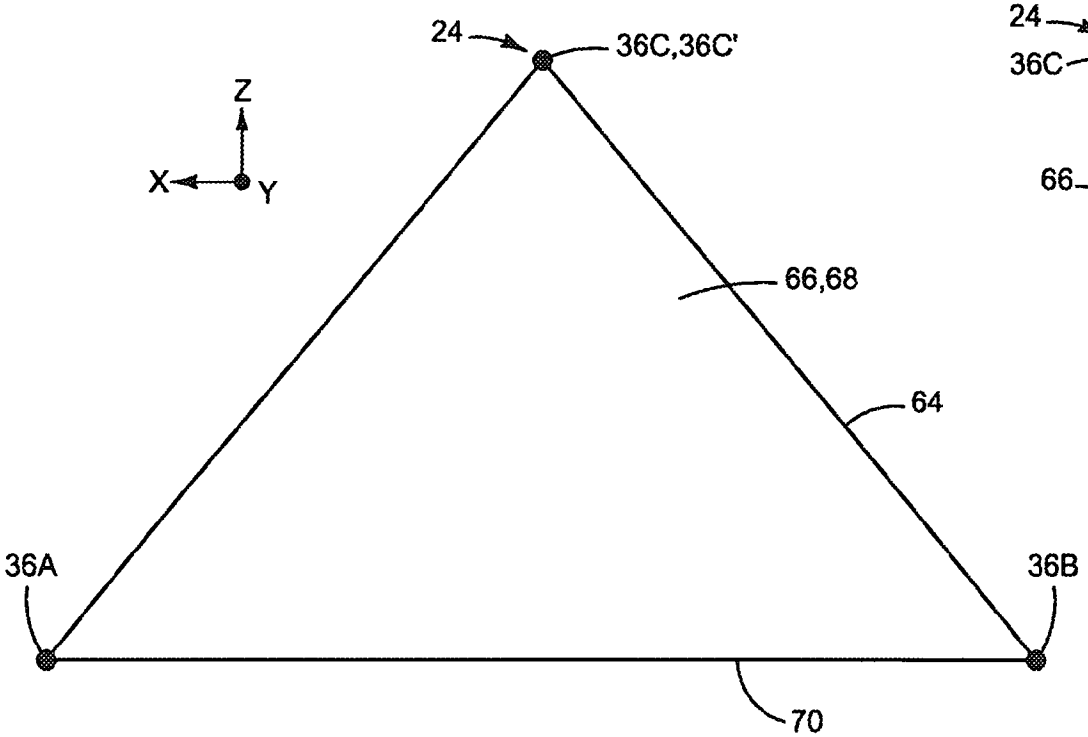

FIGS. 8 and 9 are rear and side view diagrams, respectively, illustrating adjustable printhead assembly datum 24 for printhead assembly 12. As noted above, in the example configuration shown in the figures, datum 24 forms a primary, Y datum for printhead assembly 12. Reference surfaces 36A, 36B, and 36C form a triangle 64 (FIG. 8) and define a first datum plane 66. Reference surface 36C is offset from surfaces 36A and 36B in the Y direction. Thus, reference surfaces 36A-36C do not all lie in a vertical plane and, accordingly, first datum plane 66 (defined by surfaces/points 36A-36C) is tilted relative to a vertical plane, as best seen in FIG. 9. For many inkjet printing applications, the printheads will lie in a horizontal plane when correctly aligned. It may be convenient in such applications to use a vertical plane for the Y datum. Thus, although first datum plane 66 may be used for Y datum 24, in the example shown in FIG. 9, a second, vertical datum plane 68 defined by points 36A, 36B and a third point 36C' is used for Y datum 24, where datum point 36C' is the projection of reference surface 36C in the Y direction to the vertical plane. Indeed, the datum plane used for datum 24 could be a projection of all three reference surfaces to points defining a datum plane having the desired position, orientation or other pertinent characteristic. Hence, while references surfaces 36A, 36B, and 36C represent the Y datum plane, they do not necessarily all lie in the Y datum plane.

Figure 10:
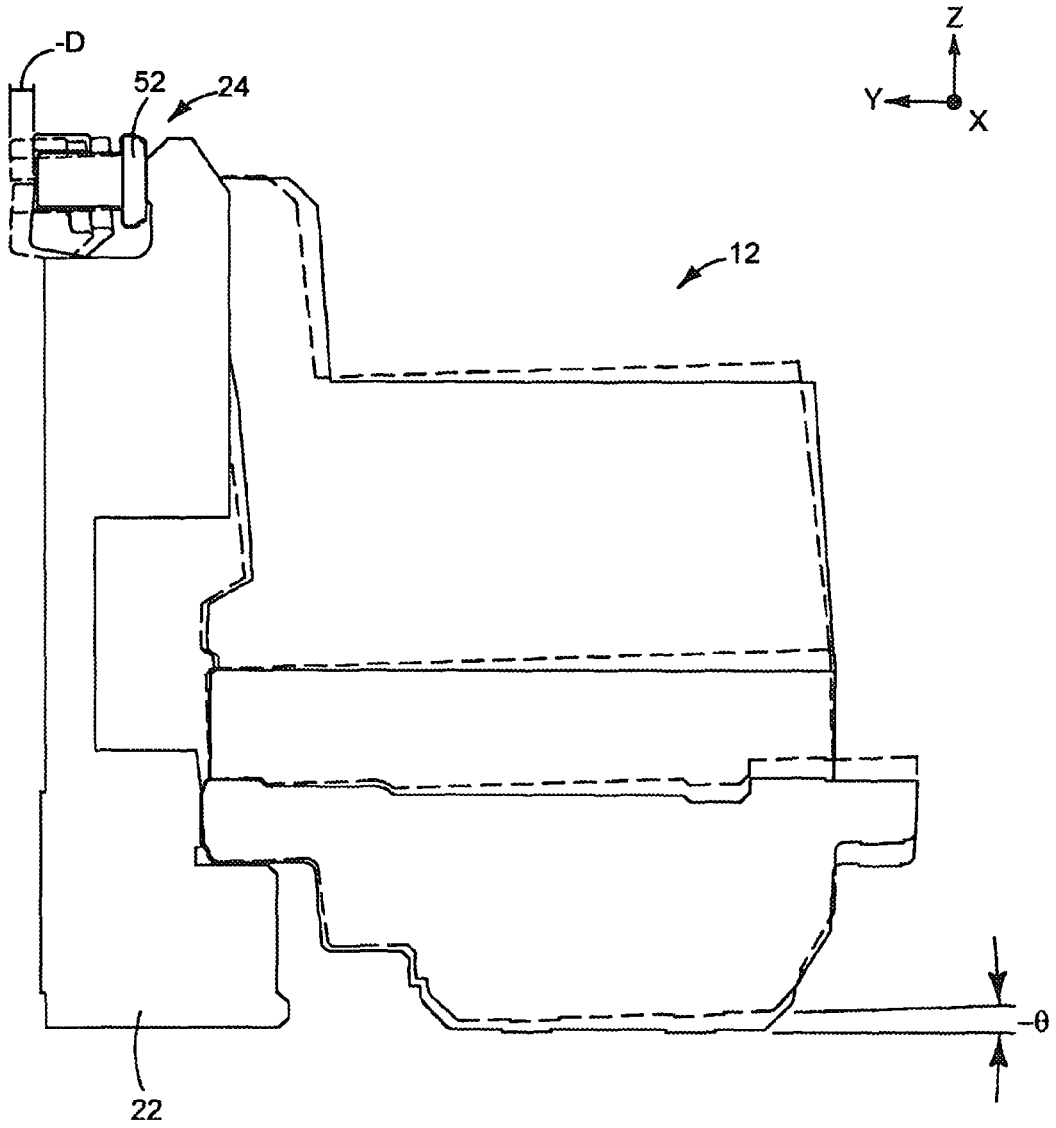
FIGS. 10 and 11 are side views illustrating alternate datum positions for the printhead assembly of FIGS. 2-4.
Figure 11:
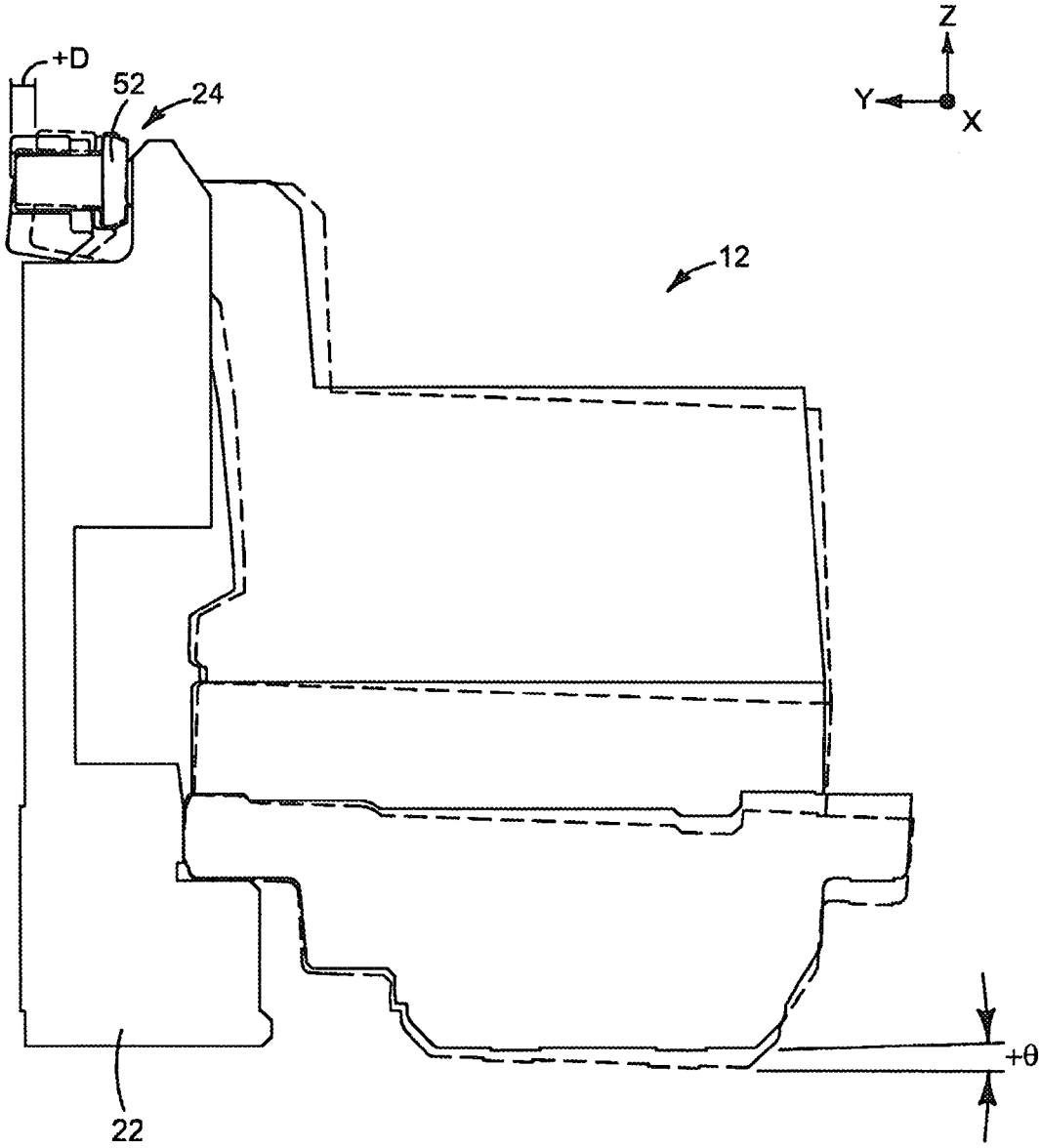

The stationary first and second datum points 36A and 36B define a line 70 (FIG. 8) that lies in datum plane 68. Line 70 forms the base of a triangle 36A,36B,36C/36C'. The vertex of the triangle opposite the base, third datum point 36C/36C', is movable in the Y direction so that datum plane 68 pivots on line 70 in response to movement of third datum point 36C/36C'. In the example shown in FIGS. 2-7, the position of third reference surface 36C on printhead assembly 12, and thus the position of datum point 36C', is adjusted by sliding pin 52 across the end of hook 50 in the Y direction, orthogonal to the XZ plane which represents the theoretically precise, desired alignment for datum plane 68. FIG. 7 shows the position of pin 52 corresponding to the desired position of third datum point 36C', designated with a solid line for a vertical datum plane 68 in FIG. 9. FIG. 10 shows the position of pin 52 corresponding to a position of third datum point 36C' misaligned a distance −D in the Y direction which causes datum plane 68 to tilt at an angle −e from the desired orientation. FIG. 11 shows the position of pin 52 corresponding to a position of third datum point 36C' misaligned a distance +D in the Y direction, which causes datum plane 68 to tilt at an angle +e from the desired orientation. The misaligned positions of datum plane 68 and pint bar 12 are designated by dashed lines in FIGS. 9-11.

Figure 12:
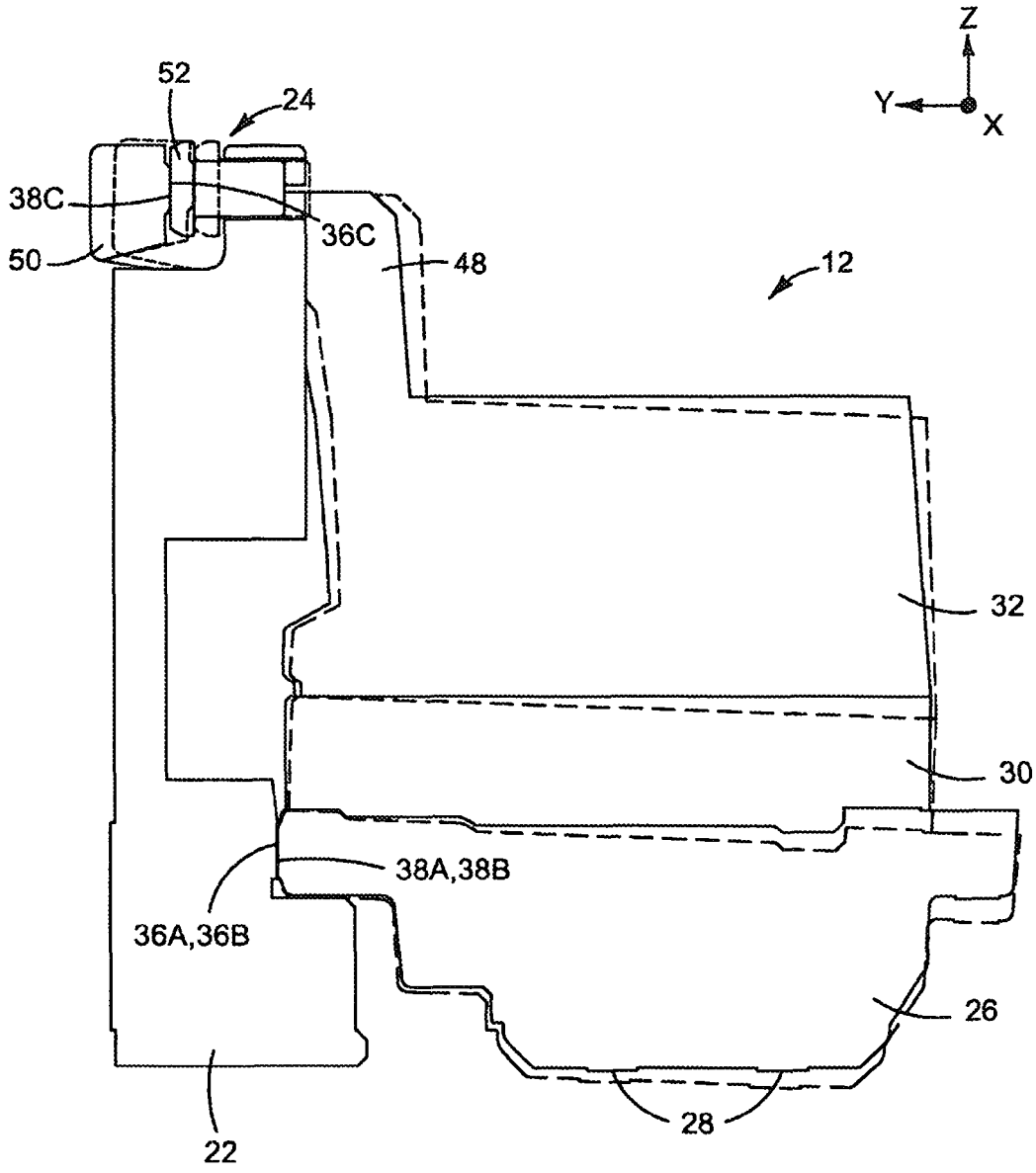
FIG. 12 is a side view illustrating a printhead assembly and printer chassis implementing another example of a new, adjustable printhead assembly datum.

In another example, shown in FIG. 12, chassis reference 38C is located on a movable pin 52 mounted in printer chassis 22. In this example, printhead assembly datum 24 is adjusted by sliding pin 52 across chassis post 56 to change the position of third datum point 36C/36C' on printhead assembly 12. Pin 52 and printhead assembly 12 are shown in two different positions in FIG. 12. A first position for pin 52 in chassis 22 and the corresponding position of printhead assembly 12 properly aligned is designated by solid lines and a second position for pin 52 in chassis 22 and the corresponding position of printhead assembly 12 misaligned are designated by dashed lines. A slidable pin 52 is just one example mechanism for adjusting the position reference surface 36C. Other suitable mechanisms may be used.

Figure 13:
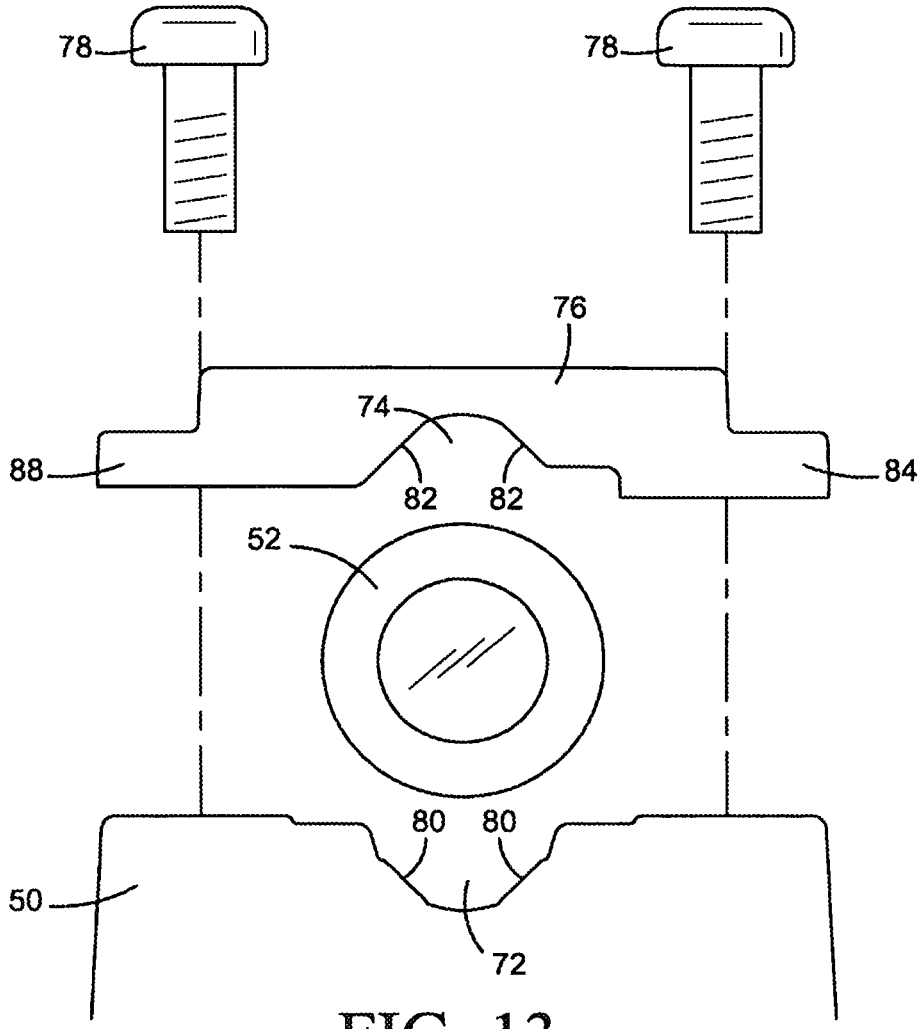
FIGS. 13 and 14 are detail views illustrating one example for a movable pin to a printhead assembly for adjusting the position of the printhead assembly datum.
Figure 14:
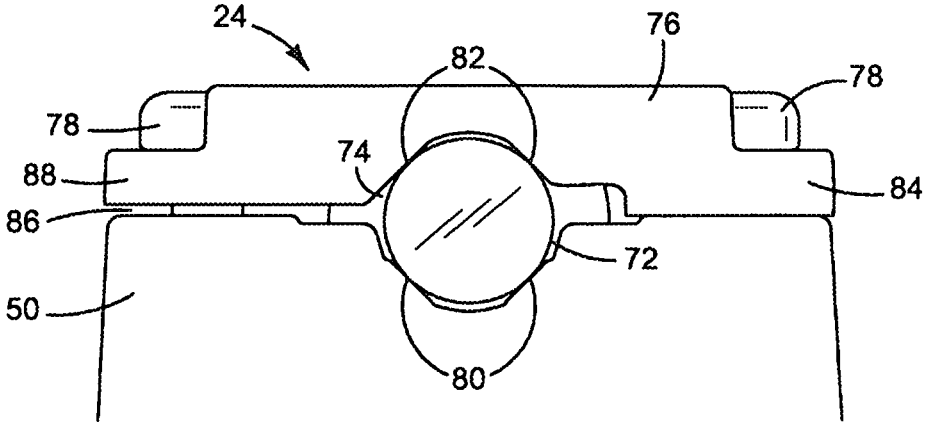

FIGS. 13 and 14 illustrate one example for attaching pin 52 to printhead assembly upper body hook 50. Referring to FIGS. 13 and 14, a round pin 52 slides in a generally V shaped groove 72 in hook 50 and in a generally V shaped groove 74 in a clamp 76. Clamp 76 is tightened against hook 50 and pin 52 with screws or other suitable fasteners 78 to secure pin 52. In one example, pin 52 is a stainless steel pin and upper body hook 50 and clamp 74 are cast aluminum parts that can be easily machined if desired to control the geometry of grooves 72 and 74. Pin 52 is supported in groove 72 along two lines of contact 80. Pin 52 is clamped in groove 74 along two lines of contact 82 opposing the hook groove lines of contact 80. This configuration for hook 50, pin 52 and clamp 76 provides sufficient contact to constrain the movement of pin 52 when clamped, while still allowing pin 52 to slide easily when not clamped, as well as generates symmetric clamping forces against pin 52 along four contact lines 80, 82. Also, in the example shown, one side 84 of clamp 74 may be drawn tight against hook 50 while a gap 86 is maintained between the other side 88 of clamp 74 and hook 50. This configuration allows clamp 74 to be pre-assembled to hook 50 and clamp side 84 tightened against hook 50 prior to adjusting the position of pin 52. Gap 86 allows the clamp to deflect slightly and wrap around pin 52, securing lines of contact 80, 82 against pin 52 as the second screw is driven in after adjusting the position of pin 52. An adhesive may be applied to one or both grooves 72, 74 after pin 52 is clamped into position if desired to increase the stability of the pin placement.

As noted above, the examples shown in the Figures and described above do not limit the invention. Other examples may be made without departing from the spirit and scope of the invention, which is defined in the following Claims.

What is claimed is:

1. A method for positioning a printhead assembly relative to a component external to the printhead assembly, the method comprising:

defining a datum plane for the printhead assembly using stationary first and second datum points and a movable datum third point, wherein the stationary first and second datum points define a line in the datum plane, and wherein the third datum point is movable so that the datum plane pivots on the line in response to movement of the third datum point.

2. The method of claim 1, wherein the third datum point is movable in a direction orthogonal to a plane representing a desired alignment of the datum plane.

3. The method of claim 1, comprising extending the line extends lengthwise along the printhead assembly.

4. The method of claim 1, comprising defining the first and second points by first and second reference surfaces on the printhead assembly and defining the third point by a projection of a third reference surface.

5. The method of claim 4, wherein the third reference surface is on the printhead assembly.

6. A printhead assembly structure, comprising:

a first part for mounting a printhead directly or indirectly through other parts, the first part extending in an X direction;

a second part attached to the first part, the second part extending in a Z direction orthogonal to the X direction;

stationary first and second reference surfaces on the first part spaced apart from one another in the X direction; and an adjustable third reference surface on the second part spaced apart from the first and second reference surfaces in the Z direction, the position of the third reference surface adjustable in a Y direction such that the position of the third reference surface relative to the position of the first and second reference surfaces may be changed.

7. The structure of claim 6, wherein the first, second, and third reference surfaces are configured to abut mating surfaces on a printer chassis or on a manufacturing fixture to establish a correct translational position of a printhead mounted to the structure in the Y direction and a correct rotational position of the printhead about X and Z axes.

8. The structure of claim 6, wherein the first, second and third reference surfaces represent a corresponding three datum points that define a datum plane for aligning the structure in the Y direction and about the X axis.

9. The structure of claim 6, wherein the first, second and third reference surfaces represent a datum for positioning the structure relative to a component external to the structure, the datum including a datum plane defined by stationary first and second datum points corresponding to the first and second reference surfaces and an adjustable third datum point corresponding to the third reference surface, the first and second datum points spaced apart from one another in the X direction and the third datum point spaced apart from the first and second datum points in the Z direction, the stationary first and second datum points defining a line in the datum plane, and the third datum point movable with the third reference surface so that the datum plane pivots on the line in response to movement of the third datum point.

10. The structure of claim 6, wherein the third reference surface is located on an end of a pin slidably mounted in the second part of the structure.

11. A printhead assembly, comprising:

a body, wherein first, second, and third datum points are located on the body to define a triangle representing a datum plane that is tiltable on a base of the triangle by moving a vertex of the triangle opposite the base; and a printhead attached to the body, wherein the first, second, and third datum points adjust a position of the printhead relative to a component external to the printhead assembly.

12. The printhead assembly of claim 11, wherein:

the body comprises multiple body parts;

the first and second datum points are defined by stationary first and second surfaces on a first body part that define the base of the triangle; and the third datum point is defined by a movable third reference surface on a second body part that forms the vertex of the triangle opposite the base.

13. The printhead assembly of claim 12, wherein the printhead comprises multiple printheads arranged across a length of the first body part.

14. The printhead assembly of claim 12, wherein the movable third reference surface is formed on a face of a pin that is slidable in a groove in the second body part.

15. The printhead assembly of claim 14, further comprising a clamp to hold the pin in the groove.

* * * * *

UNITED STATES PATENT AND TRADEMARK OFFICE

CERTIFICATE OF CORRECTION

PATENT NO. : 9,132,676 B2
APPLICATION NO. : 14/374634
DATED : September 15, 2015
INVENTOR(S) : Rosanna L Bigford et al.

It is certified that error appears in the above-identified patent and that said Letters Patent is hereby corrected as shown below:

Claims

In column 6, line 52, in Claim 3, delete “extends lengthwise” and insert -- lengthwise --, therefor.

Signed and Sealed this
Twenty-first Day of June, 2016

Michelle K. Lee

Michelle K. Lee
*Director of the United States Patent and Trademark Office*